United States Patent [19]

Bertaud

[11] Patent Number: 4,828,658

[45] Date of Patent: May 9, 1989

[54] PROCESS FOR THE PREPARATION OF MOTHER ALLOYS OF IRON AND NEODYMIUM BY ELECTROLYSIS OF OXYGEN-BEARING SALTS IN A MEDIUM OF MOLTEN FLUORIDES

[75] Inventor: Yves Bertaud, Saint-Jean-de-Maurienne, France

[73] Assignee: Aluminium Pechiney, Paris, France

[21] Appl. No.: 177,365

[22] Filed: Apr. 4, 1988

[30] Foreign Application Priority Data

Apr. 21, 1987 [FR] France ..... 87 05954

[51] Int. Cl.[4] ..... C25C 3/36; C25C 3/00; C25B 11/12

[52] U.S. Cl. ..... 204/71; 204/212; 204/243 R; 204/245; 204/247; 204/272; 204/284; 204/292; 204/294

[58] Field of Search ..... 204/71, 245, 294, 292, 204/272, 212, 246, 64 R

[56] References Cited

U.S. PATENT DOCUMENTS

| | | | |
|---|---|---|---|
| 3,383,294 | 5/1968 | Wood | 204/71 X |
| 3,524,800 | 8/1970 | Morrice, Jr. et al. | 204/71 |
| 3,729,397 | 4/1973 | Goldsmith et al. | 204/71 X |
| 4,235,692 | 11/1980 | Townsend | 204/64 R X |
| 4,684,448 | 8/1987 | Itoh et al. | 204/71 |
| 4,747,924 | 5/1988 | Itoh et al. | 204/245 X |

FOREIGN PATENT DOCUMENTS

| | | | |
|---|---|---|---|
| 49-34412 | 3/1979 | Japan | 204/71 |

*Primary Examiner*—Donald R. Valentine

*Attorney, Agent, or Firm*—Dennison, Meserole, Pollack & Scheiner

[57] ABSTRACT

The invention concerns a process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode. In accordance with the invention, the bath is primarily formed by a mixture of molten fluorides whose decomposition potential is close to that of $NdF_3$ or more negative, such as for example $NdF_3$, $MgF_2$, $ScF_3$, $CeF_3$, $LaF_3$, $BaF_2$, $CaF_2$ and $SrF_2$, and permitting solubilization of the oxides by a complexing effect, the solute to be reduced is formed by a mixture of salts primarily containing a reactive oxygen-bearing compound of neodymium which is very rapidly soluble in the molten electrolyte. The working temperature is in a range of from 640° to 1030° C., the anodic current density is from 0.1 to 1.5 $A/cm^2$, and the cathodic current density is between 2 and 30 $A/cm^2$.

32 Claims, 2 Drawing Sheets

PROCESS FOR THE PREPARATION OF MOTHER ALLOYS OF IRON AND NEODYMIUM BY ELECTROLYSIS OF OXYGEN-BEARING SALTS IN A MEDIUM OF MOLTEN FLUORIDES

TECHNICAL FIELD OF THE INVENTION

The invention concerns a process for the preparation of mother alloys of iron and neodymium by the electrolysis of a neodymium salt containing oxygen in a medium primarily containing molten fluorides, by means of an iron cathode and a carbon-base anode.

STATE OF THE ART

The literature discloses a certain number of processes which are very substantially different from our process, for producing various types of alloys containing lanthanides.

In regard to the electrolytic production of iron-neodymium alloys, the following procedures will essentially be used:

electrolysis of the neodymium oxide in a medium of molten fluorides on an iron cathode (E. MORRICE—E. SHEDD and T. HENRIE—US Bureau of Mines, report 7146, 1968). The writers very briefly describe their process which is based on a cell comprising an iron cathode and two graphite anodes. The electrolyte is composed of 11% LiF and 89% of $NdF_3$ which are molten at 985° C. The base of the liquid bath is cooled so as to solidify the droplets of alloy. The solute to be electrolysed is an ordinary neodymium oxide, the physical-chemical properties of which are not described.

It is well known that conventional calcined oxides dissolve only very slightly and in particular only very slowly in such a molten bath, which results not only in frequent polarizations in respect of concentration but also in the formation of substantial amounts of sludge at the bottom of the crucible, with decreasing efficiency of the cell. Moreover, the theoretical electrolysis voltage on a carbon anode with the formation of CO is of the order of 1.6 V. The voltage specified by the writers, of the order of 27 volts, for an amperage of 50 to 100 A, implies a dramatic over-voltage.

Precipitation of the alloy in the form of solid nodules which drop onto a solidified bath skull and which are immersed in the sludge permits them to be extracted only by stopping the electrolysis operation and breaking up the solidified bath. The process described cannot therefore be considered as workable on an industrial scale, for all those reasons.

electrolysis of neodymium chloride in a medium of molten chlorides (F. SEON and G. BARTHOLE, Rhone Poulenc, EP-A-184515), which is penalized by severe re-oxidation of the reduced metal.

electrolysis of neodymium fluoride in a medium of molten fluorides (K. ITOH et al, Sumitomo Light Metal, EP No. 177 233, which corresponds to U.S. Pat. No. 4,684,448).

That process is fundamentally different from the process which we are proposing insofar as it involves electrolysis of neodymium fluoride which is totally free of oxide, the mechanism of oxidation at the anode thereof resulting in the exclusive formation of fluorine and fluorine bearing compounds of carbon, which involves: a high theoretical decomposition voltage, substantial anodic polarization, and excessive crumbling of the carbon. Moreover treatment of the anodic residues, namely gas and carbon dust, is not described.

SUBJECT OF THE INVENTION

The present invention concerns a highly effective process which combines the advantages of the electrolysis of ions containing oxygen, dissolved in a molten fluoride, on a depolarizing consumable anode, and the suitable use of oxygen-bearing salts with high kinetics of solution.

Those compounds are particularly selected and/or prepared or may result from in-situ reactions of previously selected species. Their behaviour in the electrolysis operation is fundamentally different from that of the conventional calcined oxides.

In fact, the use of salts resulting by anodic oxidation of dissolved oxy-fluorine anions in species which react with the anodic carbon to give CO and/or $CO_2$, makes it possible substantially to reduce the voltage required for the electrolysis thereof and thereby to reduce the specific amount of energy consumed when carrying the process in effect. The salts should also free their oxides very quickly upon dissolution.

A certain number of procedures and apparatuses also make it possible substantially to enhance the level of economy of the process.

DESCRIPTION OF THE INVENTION

In accordance with the invention, the electrolyte must:

be capable of complexing oxide ions, that is to say, dissolving the solid salt to be electrolyzed by attack on the molecules thereof, be capable of dissociating the latter to form anions and cations (solvolysis) and forming by association with the ions of the solvent, soluble and stabilized anions and/or cations, maintain the degree of oxidation in which the dissolved and complexed neodymium ions occurs so as to limit the undesirable reactions at the cathode or with the reduced products, and be more stable at the electrodes that the salt to be electrolyzed, that is to say, the range of electroactivity of the solvent must totally encompass that of the salt to be electrolyzed.

In the electrolysis of a neodymium salt, the electrolyte may therefore be formed by one of the following salts or a mixture thereof: $NdF_3$, $ScF_3$, $YF_3$, $LaF_3$, $CaF_2$, $MgF_2$, $BaF_2$ and LiF. Certain additives such as $CaCl_2$, $MgCl_2$, $BaCl_2$ and LiCl may favourably modify certain physical-chemical properties of the mixtures of fluorides, for example viscosity and/or density and/or electrical resistivity.

The process which we are proposing, as illustrated in FIGS. 1 and 2, is based on the electrolysis of a compound of neodymium (i) soluble in one of the molten mixtures referred to above, (ii) whose range of electroactivity is less extensive than that of the electrolyte, (iii) whose cation reacts rapidly at the cathode, and (iv) whose anion reacts with the anode, which makes it possible to lower the electrolysis voltage: certain salts of neodymium containing oxygen which are suitably selected and/or prepared may be suitable for the use which we are proposing.

Figure 1:
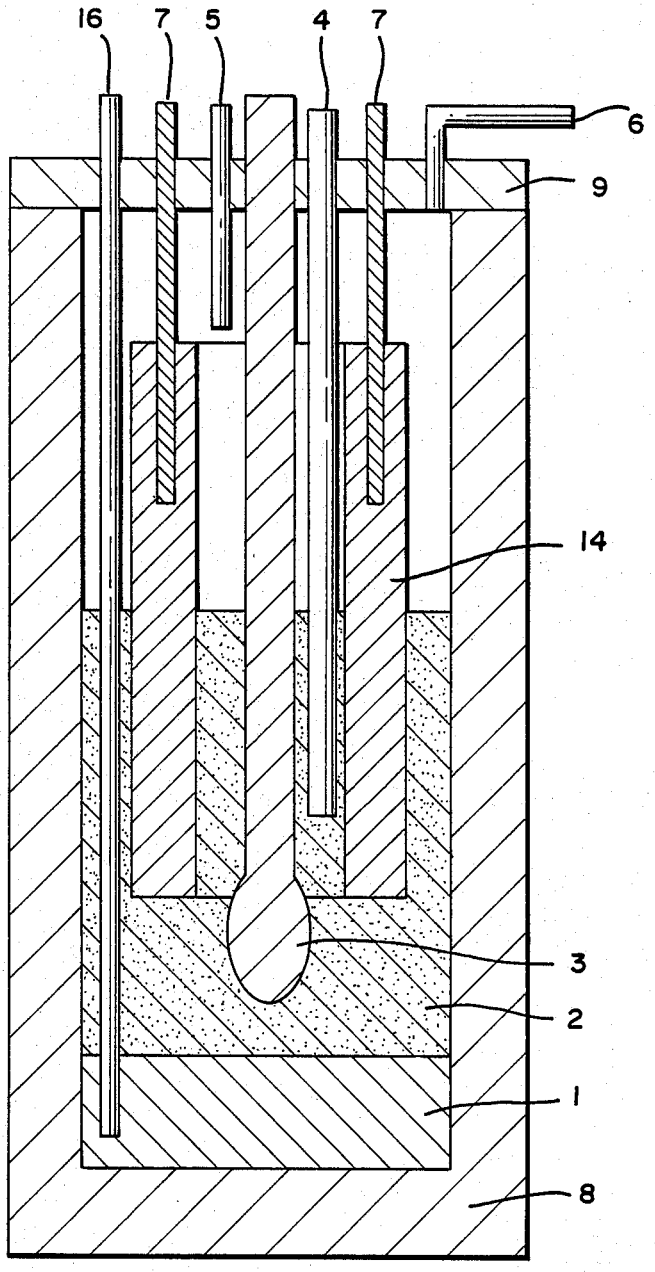
FIG. 1 shows an electrolytic cell formed by a crucible 8 of boron nitride closed by a cover 9 of the same composition, a cathode 3 of pure iron and a tubular anode 14 of carbonaceous material, which is concentric with respect to the cathode 3. The electrolyte is a molten salt 2 into which "cigarettes" or pellets of powder to be electrolyzed are introduced through a guide tube 4. The liquid alloy formed at the cathode trickles down and is collected at the bottom of the cell 1. It may be drawn off by means of a tube 16 of iron or a metal which is substantially non-attackable. The positive current inputs 7 are of inconel. The anodic gases are scavenged and entrained by an inert gas, by virtue of the inconel orifices 5 and 6.

It is on the basis of the above-described types of cells that the process will now be described in greater detail. Those cell designs do not thereby constitute a limitation in respect of the invention.

The solute to be electrolyzed must dissolve very quickly in the solvent as otherwise there may be a condition of depletion in respect of oxide ions in the vicinity of the positive electrode, which causes polarization of the electrode. By impedance-metric measurements, such as those described in the publication of G. PICARD et al, Light Metals (1987), page 507, we have found that commercially available calcined neodymium oxides are slow to dissolve, which gives rise to sludge at the bottom of the electrolytic cell and rapidly results in production coming to a halt. On the contrary neodymium oxide which is highly reactive because it is poorly crystallized, produced by controlled undercalcining of carbonate or oxalate or other organic acid neodymium salts, carbonate, oxalate, nitrate, sulphate, oxychloride and oxyfluoride of neodymium, have a completely different behaviour and can be used without difficulty, giving astonishing results.

It is noted in fact that the traces of residual hydration of the system as well as incomplete decomposition of the salt, at least in the case of the carbonate, nitrate and oxalate (and other organic salts), even more substantially promote dissolution by the in-situ creation, by local agitation linked to the departure of gases at the surface of the molten salt, of excellent dispersion of the powder and an improvement in the wetting thereof and therefore the attack thereon by means of the ionized solvent.

The level of undercalcining is selected and thus controlled after thermogravimetric analysis of the starting compound.

At the same time we have observed that the addition to the molten salt of boron oxide or neodymium borate, in a proportion of 1 to 12% (expressed in terms of $B_2O_3$), improved the dissolution kinetics, at the expense of reduction of boron at the cathode. However that presence of boron in the iron-neodymium alloy is not necessarily undesirable; it is even desired in regard to the production of iron-neodymium-boron alloys which are used in the magnet industry.

In accordance with the process, the dissolution of boron in the alloy may also be effected by additions of ferro-boron, which may or may not be mixed with the salt to be electrolyzed, in a proportion ranging up to 12% of boron.

One of the principles of the process lies in the reaction of the oxyfluoride species which are in a dissolved and adsorbed condition on the carbon anode, which makes it possible to lower the electrolysis voltage.

The current density at the anode, that is to say the speed at which the oxide ions are "consumed" is adjusted in such a way that the speed of "production" of said ions by solvolysis is at least as high as the speed of "consumption", as otherwise polarization of the electrode is found to occur.

When the cathode is formed by or covered with a metal giving an alloy-with neodymium, for example iron, nickel or cobalt, the reduced neodymium diffuses into the cathode, forms an alloy and, if the temperature permits, the alloy formed melts and flows away. In the latter case, a sufficient local temperature in the vicinity of the cathode permits the formation of a liquid film and simultaneous diffusion into that liquid of the metal of the cathodic substrate and the neodymium produced by reduction.

Neodymium is highly soluble in the above-mentioned cathodic liquid film. That solubility, by reducing the absolute value of the real decomposition voltage of the neodymium salts (action on the activity of the reduced metal in the cathodic alloy) promotes the reduction of the neodymium to the detriment of the other cations present in the solvent which are substantially insoluble in the liquid film, and enhances selectivity.

A cathodic current density is chosen which makes it possible to provide the adequate amount of neodymium for alloying with all the iron which diffuses and forming the alloy in liquid form. Otherwise the metal produced must be subsequently re-melted.

On the basis of the general principles which have just been set forth above, the precise conditions involved in carrying the process into effect are as follows:

the electrolyte is a mixture of fluorides which are molten in a range of temperatures of between 640° C., being the generally accepted value for melting the eutectic alloy Fe-Nd, and 1030° C., and preferably between 750° and 1000° C., essentially containing in percentages by weight: LiF 8 to 19% and $NdF_3$ 81 to 92%, to which there are added, as additives for modifying their chemical properties, alkaline earth halides, up to 38% by weight of the above mixture, and boron oxide ($B_2O_3$), up to 12% by weight of the mixture;

introduced into that electrolyte are oxygen-bearing solutes or a mixture thereof such as for example: reactive neodymium oxide produced by undercalcining which is controlled on the basis of the thermogravimetric variation curve of neodymium, carbonate or oxalate, carbonate, oxalate nitrate, sulphate, oxyhalide, or other organic acid salt or optionally neodymium borate, which produced by in-situ reaction highly reactive oxygen-bearing species which are capable of very rapidly dissolving in the electrolyte;

the depolarizing anode is of carbon and reacts with the oxygen produced and the bath to give a gaseous mixture containing in particular CO, $CO_2$ and $CF_4$. The current density which, for reasons of productivity of the process, must be adequate, must necessarily be lower than the limit current density, that is to say the value beyond which the amount of species which should be discharged at the anode to maintain that density becomes greater than the amount of oxide ions which arrive at the anode. If the voltage at the terminals is sufficient, the fluorides of the solvent are then electrolyzed and thus substantially non-conducting fluorocarbon surface compounds are formed: the anode polarizes, sometimes even irreversibly. That phenomenon and therefore the limit current density depends on a certain number of parameters and in particular the nature of the electrode, the speed of dissolution of the salt, that is to say the generation of oxyfluoride species, and transport of said species (convection, diffusion). In practice operation will be with an anodic density which is between 0.1 to 1.5 A/cm$^2$, but preferably between 0.3 and 1.1 A/cm$^2$;

the consumable cathode is of iron. The cathodic density must be so adjusted that the amount of iron diffusing into the liquid surface film and the amount of neodymium which undergoes electroreduction, solubilized in that film, form by combination of the two elements an alloy which is liquid at the operating temperature. That alloy can then trickle along the electrode to form at the end a drop which falls to the bottom of the crucible. In practice the cathodic working current density at the surface of the electrode is in a range of from 2 to 30 A/cm$^2$ and preferably from 4 to 20 A/cm$^2$;

the cathode may also be a "pseudo iron cathode", that is to say, a substantially non-attackable electron conductor, covered with iron deposited at the surface thereof by electrolysis, parallel with that of the compounds of neodymium, a fluoride or an iron oxide; and the iron-neodymium alloy produced by adjustment of the current densities is liquid in the range of temperatures of from 640° to 1030° C. and preferably from 750° to 950° C. It flows away and is collected in a crucible of iron or substantially non-attackable material such as for example metals: W, Mo, Ta, or ceramics: BN, $Si_3N_4$, AlN.

Careful study of the general process has permitted us clearly to specify the optimum conditions for carrying the process into effect, which we are proposing to describe and illustrate by means of specific examples.

Figure 2:
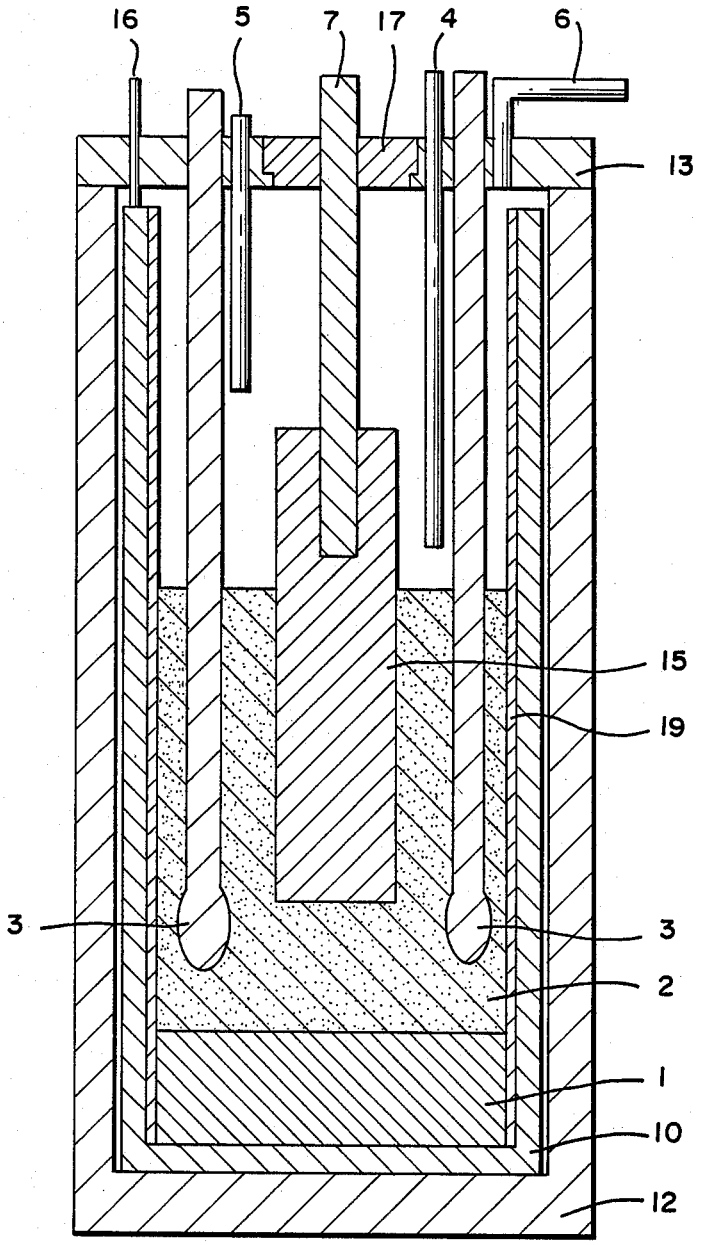
FIG. 2 shows a cell of a slightly different design. The crucible 10 is of iron or a material which is substantially non-attackable, internally protected over the height thereof by a non-conducting ceramic 19 such as for example boron nitride, disposed in a graphite container 12 and closed by a cover 13 of silicon nitride. The anode is a solid cylinder 15 of carbonaceous material surrounded by a plurality of iron cathodes 3 forming the generatrices of an outer cylinder which is concentric with the anode 15. The compound to be electrolyzed is introduced into the molten salt and the anodic gases are removed, by means of the devices 4, 5 and 6 which are identical to those shown in FIG. 1.

The ratios in respect of current density at the electrodes lead us to envisage at least two types of cell geometry such as those shown in FIGS. 1 and 2, which in themselves do not constitute a limitation in respect of the invention:

the molten bath is contained in a crucible either of ceramic material (BN, $Si_3N_4$) or of iron, graphite or of substantially non-attackable material, optionally internally protected over the height thereof where it passes through the molten bath, by a non-conducting ceramic material. The latter arrangement is proposed only in the situation where heating is effected by means of an outside furnace. In the industrial process where the heat energy is supplied by an internal Joulean effect, that non-conducting lining may be provided by a ridge of solidified bath or replaced by the sides being moved sufficiently far away;

the cathode is a cylindrical iron rod and the anode is a concentric cylinder on the same axis as the cathode (construction shown in FIG. 1);

the crucible is identical to the above-described crucible but the anode is a substantially cylindrical carbon block which is vertical and channelled to facilitate escape of the bubbles of gas, which is capable of rotating about its axis, and which is surrounded by a series of at least two cathodes composed of iron rods forming the generatrices of a cylinder which is external to the anode and which has the same axis as the anode. Mechanisation of the cathodes makes it possible for them to be moved towards or away from the anode, either alone or as a group. If the anode is immobile, preferential wear of the carbon facing the cathodes is found to occur. That type of irregular wear can be compensated by a slow rotary movement of the anode around its axis. It has also been noted however that this rotary movement gave rise to movements of the bath which on the one hand improved dispersion in the molten salt of the powder to be elctrolyzed and thus promoted dissolution thereof and which on the other hand permitted better removal of the bubbles of gas at the surface of the anode. The speed of rotation which is adapted to the size of the cells is generally in a range of from 1 to 20 revolutions per minute, depending on the effects that are to be produced;

analysis by bubbling, chromatography and mass spectrography of the anodic gases taken off on a sealed nitrogen-scavenged cell shows that the gases, polluted with dust from the cell, essentially consist of HF, CO, $CO_2$ and $CF_4$. It is possible to arrest the dust and HF in a system formed by a bed of granule material, produced by pelleting, crushing and calibration of powder of the compound of neodymium to be electrolyzed, and a sleeve-type or pocket-type filter. The gases may also be directed over a wet scrubber. A little neodymium chloride which is capable of reacting with dilute HF is injected into the solution. The suspension which essentially contains $NdF_3$ and cell dust results after treatment in a powder which can be used as the solute to be electrolyzed. Residual CO, $CO_2$ and $CF_4$ which have passed through one of the collecting systems are treated so as to oxidize the CO to form $CO_2$, with the reaction being controlled by means of a sensor for analyzing unburnt reducing gases to fix the $CO_2$ on a bed of lime, and thus to recover the $CF_4$. That gas may then be pre-purified over molecular sieves, liquefied and distilled;

the $CF_4$ bear witness to a parasitic reaction with the bath and leads to envisaging a mixture containing neodymium oxyfluoride, as the solute to be electrolyzed. That compound can be produced by a reaction similar to that described hereinbefore in the case of a wet treatment, namely reaction of a dilute aqueous solution of hydrofluoric acid with a solution of neodymium chloride. The colloidal precipitate obtained is dried and then moderately calcined X-ray analysis shows that it is a mixture containing NdOF and $NdF_3$;

however an attempt is made to reduce the parasitic reaction resulting in $CF_4$, by limiting the formation of fluorine insertion compounds in the carbon by using composite anodes based on non graphitisable cokes containing oxides. For that purpose, the procedure involves producing mixtures of granules of carbon with isotropic tendency (such as for example pitch coke or Gilsonite coke), from 1 to 25% of oxide of iron and/or nickel and/or neodymium, and from 1 to 22% of coal tar pitch.

Those mixtures are shaped and baked, being graphitized or ungraphitized, at from 950° to 3000° C. and preferably from 1050° to 1250° C. When using such anodes, it is possible to observe not only a reduction in the amount of $CF_4$ produced but also a substantial drop in the anodic over-voltage as a result of the electrocatalytic effect of the oxides used;

on the cathodic side the liquid alloy formed trickles down and flows away into the crucible which is of iron or substantially non-attackable material. In order to avoid any reaction with the bath, giving rise to the loss of a part of the metal produced, it may be an attractive proportion to raise the metal layer to a potential intermediate between that of the anode and the cathode but close to the latter, provided however that the electrochemical process between the carbon anode and the iron cathode of small selection is not interfered with. The bottom liquid alloy and the metal portions which may contain it are kept at a spacing from the electrodes. The potential is applied by way of a resistance of very high value, for limiting leakage currents between the anode and the bottom alloy, and between the bottom alloy and the cathode. If the crucible is an electronic conductor, that potential is applied to the crucible. Otherwise, the apparatus uses a substantially non-attackable electron-conducting rod which is raised to that potential (for example tungsten), sheathed with boron nitride where it passes through the bath, while the other free end thereof dips into the reduced metal pad; and as regards the metal, it is regularly drawn off using a tube of iron or of substantially non-attackable metal, which therefore does not cause any troublesome pollution of the liquid alloy, by being sucked off into a ladle in which the pressure is reduced to below 50 kPa, which naturally makes the process a continuous and industrial one.

A number of embodiments of our process are set out hereinafter by way of non-limiting examples:

EXAMPLE 1

This Example uses a cell such as that shown in FIG. 1, comprising a cylindrical crucible 8 of boron nitride, with an inside diameter of 10 cm, a cathode 3 formed by a pure iron rod with a diameter of 0.4 cm, and an anode 14 formed by a carbon tube with an inside diameter of 7 cm, disposed concentrically with respect to the cathode and produced from a mixture of Gilsonite coke and 2% of $Fe_2O_3$ as an electro-catalyst. The electrodes dip 3 cm into the electrolyte.

The cell is equipped with a cover 9 which is kept under a slightly increased pressure of neutral gas which is intended to entrain the anodic gases by way of orifices 5 and 6 and to prevent the intake of air. The assembly is put into an electrical furnace which can reach temperatures in the vicinity of 1100° C.

The bath of salts 2 used is a mixture (by weight) of LiF 13%, $BaF_2$ 31%, and $NdF_3$ 56%, which is molten at 870° C.

The tube 4 is used to feed the cell by means of "cigarettes" of a diameter of 6 mm, a length of 30 mm and a weight of 3 g of neodymium oxalate which has been previously calcinated at 500° C. so that transformation into oxide is not complete. The residual volatile compounds which abruptly escape upon coming into contact with the molten bath permit dispersion of the powder and more rapid dissolution of the particles in the molten salt.

The amperage which passes through the cell is 45 A, corresponding to a cathodic current density of 11.9 A/cm$^2$ and an anodic current density of 0.68 A/cm$^2$. The voltage at the terminals is kept constant (9 V) by means of a potentiostatic assembly. The recording of amperage is then found to have "waves" corresponding to the formation of the drops and the flow thereof towards the bottom of the crucible.

Analysis of the gases by gaseous phase chromatography, after trapping of HF and dust, gives in a semi-continuous procedure the following composition by volume: $CF_4$ 12%, $CO_2$ 8%, CO 80%.

The composition of the electrolyte is corrected in dependence on those results, by adding cigarettes of $NdF_3$, in addition to the ex-oxalate reactive oxide.

As regards the gases, they bubble into an alkaline aqueous solution and then pass over a catalyst, which, in the presence of an amount of oxygen which is pilot-controlled by a zirconia sensor, makes it possible to achieve virtually total transformation of the CO into $CO_2$.

The last traces of CO are trapped by bubbling through ammoniacal copper formiate, and $CO_2$ and water vapour, over a potassium oxide bed. Treatment of the gases is terminated by passing them over a succession of molecular sieves. At the discharge, a tetrafluoromethane $CF_4$ is obtained which, after liquefaction and distillation, and be put to use in the electronic industry.

Electrolysis is continued for a period of 32 hours by virtue of regular introductions of undercalcined oxalate cigarettes and if necessary $NdF_3$, and a regular introduction of cathodic iron rods into the molten salt, as they are consumed. At the end of the experiment, the liquid metal contained in the bottom of the crucible is drawn off by way of an iron tube and it is siphoned under an argon atmosphere into a container of boron nitride which is provided with a cover.

The balance sheet of the operation is set forth in Table 1 and analysis of the metal obtained is set out in Table 4.

TABLE 1

| EXPERIMENTAL CONDITIONS | | | | |
|---|---|---|---|---|
| BATH | | | CRUCIBLE Boron nitride | |
| $NdF_3$ | % | 56 | ELECTRODES: | |
| LiF | % | 13 | Cathode | pure iron (1) |
| $BaF_2$ | % | 31 | Anode | Carbon |
| $B_2O_3$ | % | 0 | | Gilsonite coke |
| Temperature °C. 870 | | | | Coal tar pitch |
| | | | | Additive 2% $Fe_2O_3$ |
| | | | | Baking 1150° C. |
| OPERATION OF THE CELL | | | | |
| Cell voltage | V | 9 | | |
| Cell amperage | A | 45 | | |
| Cathodic current density | A/cm$^2$ | 11.9 | | |
| Anodic current density | A/cm$^2$ | 0.68 | | |
| Addition of Nd salts: 340 cigarettes (6 g) of reactive oxide + volatile materials, namely 1925 g of $Nd_2O_3$ and 40 cigarettes of $NdF_3$ (correction) | | | | |
| Duration 32 hours | | | | |
| RESULTS | | | | |
| Weight of alloy produced (g) | | | 1890 g | |
| Weight of neodymium produced (g) | | | 1625 g | |
| Current Efficiency 63% | | | | |

EXAMPLE 2

This Example uses a cell (FIG. 2) which is slightly different from that described in Example 1. A deep crucible 10 of pure iron which is internally protected over its height by a sleeve 19 of boron nitride is disposed in a graphite container 12. Provided with a cover 13 of silicon nitride, and channelled cylindrical carbon anode 15 produced from pitch coke, of a diameter of 7 cm, is solid and is moved with a slow rotary movement (6 revolutions per minute). It is surrounded by 4 cylindrical cathodes 3 of soft iron, of a diameter of 0.2 cm. The electrodes dip 2 cm into the electrolyte produced by melting and keeping at 850° C. in an electrical furnace, 78% of $NdF_3$, 17% of LiF and 5% of boron oxide, by weight.

In this case, "cigarettes" of a diameter of 4 mm and a length of 30 mm and weighing 6 g of neodymium carbonate under-calcined at 500° C. are used as the regular supply of electrolyte in such a way that the residual volatile species disperse the powder in the electrolyte whose level in the cell and the composition in respect of $NdF_3$ and $B_2O_3$ are kept constant by additions after regular analyses of the bath.

The cell is operated at 8.4 volts and 39 A, corresponding to a cathodic density of 7.8 A/cm$^2$ and an anodic density of 0.89 A/cm$^2$. Wear of the anode results in an increase in the anodic density which, before the end of the experiment, requires a change of anode before irreversible polarization occurs. The standard exchange is very rapid due to the use of the "central anodic cover" 17.

After 53 hours of electrolysis controlled by regular additions of reactants and the introduction of cathodes in dependence on the consumption thereof under conditions similar to those of Example 1, the anodic and cathodic equipment, the cover and the ancillary devices are removed. The iron crucible is then removed and, for reasons of simplicity, the whole is poured into a large graphite container. It is left to cool and the metal is mechanically separated from the solidified bed. The results of that test and analysis of the metal are set forth in Tables 2 and 4.

TABLE 2

| EXPERIMENTAL CONDITIONS | | | | |
|---|---|---|---|---|
| BATH | | | CRUCIBLE Iron | |
| $NdF_3$ | % | 78 | ELECTRODES | |
| LiF | % | 17 | Cathodes | Pure iron (4) |
| $BaF_2$ | % | 0 | Anode | Carbon |
| $B_2O_3$ | % | 5 | | Tar coke |
| Temperature °C. 920 | | | | Coal tar |
| | | | | Baking 1150° C. |
| OPERATION OF THE CELL | | | | |
| Cell voltage | V | 8.4 | | |
| Cell amperage | A | 39 | | |
| Cathodic current density | A/cm$^2$ | 7.8 | | |
| Anodic current density | A/cm$^2$ | 0.89 | | |
| Additions of Nd salts: 430 cigarettes (6 g) of reactive oxide + volatile materials, namely 2460 g of $Nd_2O_3$, 55 of $NdF_3$ and 16 of $B_2O_3$. | | | | |
| Duration 53 hours | | | | |
| RESULTS | | | | |
| Weight of alloy produced (g) | | 2640 g | | |
| Weight of neodymium produced (g) | | 2110 g | | |
| Current Efficiency 57% | | | | |

EXAMPLE 3

The geometry of the cell is identical to that of Example 2 (FIG. 2), with a molybdenum crucible 10. This time however the anode is of a different composition. It is produced from a mixture (by weight) of pitch coke 74%, neodymium oxide 11% and coal tar pitch 15%; the paste is mixed at 150° C., pressed at 100° C. and baked at 1150° C.

The electrolyte is identical to that of Example 2 but the salt to be electrolyzed, which is partially composed of a mixture of reactive oxide and neodymium oxyfluoride, is produced in the following manner:

by means of a bubbling of gaseous hydrofluoric acid diluted in air into an aqueous solution of neodymium chloride, a colloidal precipitate is obtained which is dried in a drying oven and then heated at 850° C. for 30 minutes. Analysis by X-ray diffraction shows that this is a mixture of oxyfluoride (majority phase), fluoride and oxide of neodymium. That powder is then mixed with ex-oxalate reactive oxide as used in Example 1;

the electrolysis operation (25 hours) is carried on under conditions similar to those of Example 2, namely 36 A, 7.8 V, that is to say 0.82 A/cm$^2$ anodic current density and 7.16 A/cm$^2$ cathodic current density. The corrections in respect of electrolyte composition are effected in a finer fashion on the basis of bath samples (1 per hour) which are quickly analyzed by X-ray diffraction. The test conditions and results are set forth in Tables 3 and 4.

TABLE 3

| EXPERIMENTAL CONDITIONS | | | | |
|---|---|---|---|---|
| BATH | | | CRUCIBLE Molybdenum | |
| $NdF_3$ | % | 78 | ELECTRODES | |
| LiF | % | 17 | Cathodes | Pure iron (4) |
| $BaF_2$ | % | 0 | Anode | Pregraphitic carbon |
| $B_2O_3$ | % | 5 | pitch coke | 74% |
| Temperature °C. 920 | | | Coal tar pitch | 15% |
| | | | Additive $Nd_2O_3$ | 11% |
| | | | Baking 1150° C. | |
| OPERATION OF THE CELL | | | | |
| Cell voltage | V | 7.8 | | |
| Cell amperage | A | 36 | | |
| Cathodic current density | A/cm$^2$ | 7.2 | | |
| Anodic current density | A/cm$^2$ | 0.82 | | |
| Additions of Nd salts: 190 cigarettes (6 g) of reactive oxide + volatile materials comprising 50 mixed reactive $Nd_2O_3$ + "recovered" NdOF and 8 of $B_2O_3$ | | | | |
| Duration 25 hours | | | | |
| RESULTS | | | | |
| Weight of alloy produced (g) | | | 1160 g | |
| Weight of neodymium produced (g) | | | 950 g | |
| Current Efficiency 59% | | | | |

TABLE 4

| Results of analysis of the samples of iron-neodymium alloy | | | |
|---|---|---|---|
| | EXPERIMENT No 1 | EXPERIMENT No 2 | EXPERIMENT No 3 |
| Nature of the main solute | Ex-oxalate reactive oxide | Ex-carbonate reactive oxide | Ex-oxalate reactive oxide |
| Electrolysis temperature | 870° C. | 920° C. | 920° C. |
| Elements* | | | |
| Nd % | 86 | 80 | 82 |
| Fe % | 13 | 18 | 16 |
| B % | <0.01 | 0.8 | 0.7 |
| Li ppm | <100 | <100 | <100 |

TABLE 4-continued

| Results of analysis of the samples of iron-neodymium alloy | | | |
|---|---|---|---|
| | EXPERIMENT No 1 | EXPERIMENT No 2 | EXPERIMENT No 3 |
| Nature of the main solute | Ex-oxalate reactive oxide | Ex-carbonate reactive oxide | Ex-oxalate reactive oxide |
| Electrolysis temperature | 870° C. | 920° C. | 920° C. |
| Ba ppm | 400 | <100 | <100 |
| Ca ppm | <100 | <100 | <100 |
| F ppm | 700 | 800 | 600 |

*Make-up amount to 100 = other rare earths contained in the solute and $NdF_3$ (mainly Pr, La, Ce).

I claim:

1. A process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode, characterised in that in order to reduce the specific amount of energy and to lower the operating cost of the process:

the bath is primarily formed of a mixture of molten fluorides whose decomposition potential is close to that of $NdF_3$, $MgF_2$, $ScF_3$, $YF_3$, $CeF_3$, $LaF_3$, $BaF_2$, $CaF_2$ and $SrF_2$ and permitting solubilization of the oxides by a complexing effect, the solute to be reduced is formed by a mixture of salts containing primarily a reactive oxygen-bearing compound of neodymium for producing by in-situ reactions highly reactive oxygen-bearing species capable of rapidly dissolving in the molten electrolyte, The working temperature is in a range of from 640° to 1030° C., the anodic current density is from 0.1 to 1.5 $A/cm^2$, the cathodic current density is between 2 and 30 $A/cm^2$.

2. A process according to claim 1 characterised in that the molten electrolyte is formed by a base mixture of LiF 8 to 19% by weight and $NdF_3$ 81 to 92% by weight.

3. A process according to claim 2 characterised in that besides LiF and $NdF_3$, the molten salt contains a barium and/or calcium and/or magnesium halide in the range of compositions LiF 12 to 19% by weight, $NdF_3$ 50 to 65% by weight, barium and/or calcium and/or magnesium halide up to 38% by weight.

4. A process according to claim 1 characterised by adding up to 12% of boron oxide to the molten electrolyte.

5. A process according to claim 4 characterised by adding preferably from 1 to 5% of boron oxide to the molten electrolyte.

6. A process according to claims 1, 2, 3, 4, or 5 characterised in that the substance to be dissolved in the molten electrolyte and to be reduced at the cathode is a highly reactive oxide produced by controlled under-calcining of neodymium carbonate or oxalate.

7. A process according to claim 1, 2, 3, 4, or 5 characterised in that the substance to be dissolved in the molten electrolyte and to be reduced at the cathode is formed by one of the following components or the mixture thereof: neodymium carbonate, neodymium oxalate, neodymium organic acid salt, neodymium sulphate, neodymium nitrate and neodymium oxyfluoride.

8. A process according to claim 1 characterised by adding to the salt to be electrolyzed, boron oxide or neodymium borate, in an amount up to 12% (expressed in respect of B/Nd in the salt to be electrolyzed).

9. A process according to claim 1 characterised by adding ferro-boron 12% by weight (expressed in terms of boron) to the salt to be electrolyzed.

10. A process according to claim 1 characterised in that the iron cathode is vertical and that the anode is a tube of carbonaceous material, concentric with the cathode.

11. A process according to claim 1 characterised in that the cathode is vertical and said vertical cathodic comprises a carrier which is a substantially non-attackable material and that iron is deposited on the surface thereof by electrolysis of an iron salt mixed up to 30% with additions of neodymium salts to be electrolyzed.

12. A process according to claim 1 characterised in that the anode comprises a substantially cylindrical and vertical anode of carbonaceous material is surrounded by a series of at least two vertical cathodes constituting the generatrices of a cylinder outside the anode.

13. A process according to claim 12 characterised in that the anode is moved with a rotary movement at from 1 to 20 revolutions per minute.

14. A process according to claim 1 characterised in that the anode is formed by a mixture of coal tar pitch, and non-graphitisable coke with a texture having an isotropic tendency such as for example certain petroleum cokes, pitch coke or Gilsonite coke, and in that the mixture is baked at a temperature of higher than 950° C.

15. A process according to claim 14 characterised in that neodymium oxide is added up to an amount of 25% by weight of coke to the coke-pitch anodic mixture and that the whole is baked at least at 950° C.

16. A process according to claim 14 or claim 15 characterised by adding to the coke pitch anodic mixture an electro-catalyst, the aim of which is to lower the anodic over-voltage, such as for example iron oxide and/or Ni oxide, up to an amount of 25% by weight of coke, and that the whole is baked at at least 950° C.

17. A process according to claim 1 characterised in that the crucible for collecting the liquid cathodic alloy is a material selected from graphite, iron, molybdenum, tungsten, tantalum, and boron or aluminium or silicon nitrides.

18. A process according to claim 1 characterised in that the mother alloy in the crucible is maintained at a potential between that of the cathode and the median potential between the anode and the cathode.

19. A process according to claim 1 characterised in that the anodic gases produced are collected and treated in a wet scrubber, the aqueous solution resulting therefrom reacting with neodymium chloride to give a suspension resulting in the production of a mixture of neodymium salts containing oxyfluoride.

20. A process according to claim 1 characterised in that the anodic gases produced are collected and treated by absorption on the powder of neodymium salt which is intended to be electrolyzed.

21. A process according to claim 20 characterised in that the non-absorbed gases are treated so as to separate $CF_4$ from the other constituents.

22. A process according to claim 21 characterised in that separated $CF_4$ is purified by being passed over a molecular sieve and then be liquefaction and fractional distillation.

23. A process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode, characterised in that in order to reduce the specific amount of energy and to lower the operating cost of the process:

the bath is primarily formed of a mixture of molten fluorides whose decomposition potential is close to that of $NdF_3$, $MgF_2$, $ScF_3$, $YF_3$, $CeF_3$, $LaF_3$, $BaF_2$, $CaF_2$ and $SrF_2$ and permitting solubilization of the oxides by a complexing effect, the solute to be reduced is formed by a mixture of salts containing primarily a reactive oxygen-bearing compound of neodymium which is very rapidly soluble in the molten electrolyte, The working temperature is in the range of from 640° to 1030° C., the anodic current density is from 0.1 to 1.5 A/cm$^2$, the cathodic current density is between 2 and 30 A/cm$^2$, which process is further characterised by adding up to 12% of boron oxide to the molten electrolyte.

24. A process according to claim 23 characterised by adding preferably from 1 to 5% of boron oxide to the molten electrolyte.

25. A process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode, characterised in that in order to reduce the specific amount of energy and to lower the operating cost of the process:

the bath is primarily formed of a mixture of molten fluorides whose decomposition potential is close to that of $NdF_3$, $MgF_2$, $ScF_3$, $YF_3$, $CeF_3$, $LaF_3$, $BaF_2$, $CaF_2$ and $SrR_2$ and permitting solubilization of the oxides by a complexing effect, the solute to be reduced is formed by a mixture of salts containing primarily a reactive oxygen-bearing compound of neodymium which is very rapidly soluble in the molten electrolyte, The working temperature is in a range of from 640° to 1030° C., the anodic current density is from 0.1 to 1.5 A/cm$^2$, the cathodic current density is between 2 and 30 A/cm$^2$, which process is further characterised by adding to the salt to be electrolyzed, boron oxide or neodymium borate, in an amount up to 12%, expressed in respect of B/Nd in the salt to be electrolyzed.

26. A process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode, characterised in that in order to reduce the specific amount of energy and to lower the operating cost of the process:

the bath is primarily formed of a mixture of molten fluorides whose decomposition potential is close to that of $NdF_3$, $MgF_2$, $ScF_3$, $YF_3$, $CeF_3$, $LaF_3$, $BaF_2$, $CaF_2$ and $SrF_2$ and permitting solubilization of the oxides by a complexing effect, the solute to be reduced is formed by a mixture of salts containing primarily a reactive oxygen-bearing compound of neodymium which is very rapidly soluble in the molten electrolyte, The working temperature is in a range of from 640° to 1030° C., the anodic current density is from 0.1 to 1.5 A/cm$^2$, the cathodic current density is between 2 and 30 A/cm$^2$, which process is further characterised by adding ferro-boron 12% by weight, expressed in terms of boron, to the salt to be electrolyzed.

27. A process for the electrolyte preparation of a mother alloy of iron and neodymium by the reduction of a mixture comprising at least one reactive oxygen-bearing compound of neodymium in a bath of molten halides with at least one metallic cathode, preferably of iron, and a carbon anode, characterised in that in order to reduce the specific amount of energy and to lower the operating cost of the process:

the bath is primarily formed of a mixture of molten fluorides whose decomposition potential is close to that of $NdF_3$, $MgF_2$, $ScF_3$, $YF_3$, $CeF_3$, $LaF_3$, $BaF_2$, $CaF_2$ and $SrF_2$ and permitting solubilization of the oxides of a complexing effect, the solute to be reduced is formed by a mixture of salts containing primarily a reactive oxygen-bearing compound of neodymium which is very rapidly soluble in the molten electrolyte, The working temperature is in a range of from 640° to 1030° C., the anodic current density is from 0.1 to 1.5 A/cm$^2$, the cathodic current density is between 2 and 30 A/cm$^2$, which process is further characterised in that the substantially cylindrical and vertical anode of carbonaceous material is surrounded by a series of at least two vertical cathodes constituting the generatrices of a cylinder outside the anode, and that the anode is moved with a rotary movement at from 1 to 20 revolutions per minute.

28. A process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode, characterised in that in order to reduce the specific amount of energy and to lower the operating cost of the process:

the bath is primarily formed of a mixture of molten fluorides whose decomposition potential is close to that of $NdF_3$, $MgF_2$, $ScF_3$, $YF_3$, $CeF_3$, $LaF_3$, $BaF_2$, $CaF_2$ and $SrF_2$ and permitting solubilization of the oxides by a complexing effect, the solute to be reduced is formed by a mixture of salts containing primarily a reactive oxygen-bearing compound of neodymium which is very rapidly soluble in the molten electrolyte, The working temperature is in a range of from 640° to 1030° C., the anodic current density is from 0.1 to 1.5 A/cm$^2$, the cathodic current density is between 2 and 30 A/cm$^2$, which process is further characterised in that the anode is formed by a mixture of coal tar pitch, and non-graphitizable coke with a texture having an isotropic tendency such as for example certain petroleum cokes, pitch coke or Gilsonite coke, and in that the mixture is baked at a temperature of higher than 950° C.

29. A process according to claim 28 characterised in that neodymium oxide is added up to an amount of 25% by weight of coke to the coke-pitch anodic mixture and that the whole is baked at least at 950° C.

30. A process according to claim 28 or claim 29 characterised by adding to the coke pitch anodic mixture an electro-catalyst, the aim of which is to lower the anodic over-voltage, such as for example iron oxide and/or Ni oxide, up to an amount of 25% by weight of coke, and that the whole is baked at at least 950° C.

31. A process for the electrolytic preparation of a mother alloy of iron and neodymium by the reduction of a mixture comprising at least one reactive oxygen-bearing compound of neodymium in a bath of molten halides with at least one metallic cathode, preferably of iron, and a carbon anode, characterised in that in order to reduce the specific amount of energy and to lower the operating cost of the process:

the bath is primarily formed of a mixture of molten fluorides whose decomposition potential is close to that of $NdF_3$, $MgF_2$, $ScF_3$, $YF_3$, $CeF_3$, $LaF_3$, $BaF_2$, $CaF_2$ and $SrF_2$ and permitting solubilization of the oxides by a complexing effect, the solute to be reduced is formed by a mixture of salts containing primarily a reactive oxygen-bearing compound of neodymium which is very rapidly soluble in the molten electrolyte, The working temperature is in a range of from 640° to 1030° C., the anodic current density is from 0.1 to 1.5 $A/cm^2$, the cathodic current density is between 2 and 30 $A/cm^2$, which process is further characterised in that the anodic gases are collected and treated by absorption on the powder of neodymium salt which is intended to be electrolyzed, and the non-absorbed gases are treated so as to separate $CF_4$ from the other constituents.

32. A process according to claim 31 characterised in that separated $CF_4$ is purified by being passed over a molecular sieve and then by liquefaction and fractional distillation.

* * * * *